US007645118B2

(12) United States Patent
Khanin et al.

(10) Patent No.: US 7,645,118 B2
(45) Date of Patent: Jan. 12, 2010

(54) GUIDE VANE FOR ROTARY TURBO MACHINERY

(75) Inventors: Alexander Khanin, Moscow (RU); Alexander Checkanov, Moscow (RU)

(73) Assignee: Alstom Technology Ltd., Baden (CH)

( * ) Notice: Subject to any disclaimer, the term of this patent is extended or adjusted under 35 U.S.C. 154(b) by 146 days.

(21) Appl. No.: 11/859,493

(22) Filed: Sep. 21, 2007

(65) Prior Publication Data

US 2008/0050230 A1 Feb. 28, 2008

Related U.S. Application Data

(63) Continuation of application No. PCT/EP2006/060880, filed on Mar. 20, 2006.

(30) Foreign Application Priority Data

Mar. 24, 2005 (DE) ..... 10 2005 013 794

(51) Int. Cl.
*F01D 25/00* (2006.01)

(52) U.S. Cl. ..... 415/191; 415/209.2; 415/209.3; 415/213.1

(58) Field of Classification Search ..... 415/191, 415/209.2, 209.3, 213.1
See application file for complete search history.

(56) References Cited

U.S. PATENT DOCUMENTS

| | | | | |
|---|---|---|---|---|
| 3,300,178 | A | 1/1967 | Waheeb et al. | |
| 3,841,787 | A | 10/1974 | Scalzo | |
| 3,938,906 | A | 2/1976 | Michel et al. | |
| 4,314,792 | A * | 2/1982 | Chaplin | 415/116 |
| 4,384,822 | A | 5/1983 | Schweikl et al. | |
| 5,078,576 | A | 1/1992 | Hayton et al. | |
| 5,118,120 | A | 6/1992 | Drerup et al. | |
| 5,129,783 | A | 7/1992 | Hayton et al. | |
| 5,154,577 | A | 10/1992 | Kellock et al. | |
| 5,639,211 | A * | 6/1997 | Bintz | 415/173.7 |
| 5,820,336 | A | 10/1998 | Hashimoto et al. | |
| 6,939,106 | B2 * | 9/2005 | Murphy et al. | 415/209.2 |
| 7,172,388 | B2 * | 2/2007 | Synnott | 415/135 |
| 2004/0219014 | A1 | 11/2004 | Synnott | |

FOREIGN PATENT DOCUMENTS

| | | | |
|---|---|---|---|
| DE | 3341871 | A1 | 5/1985 |
| EP | 0945597 | A | 9/1999 |
| GB | 1605309 | A | 2/1989 |

* cited by examiner

*Primary Examiner*—Ninh H Nguyen
(74) *Attorney, Agent, or Firm*—Volpe and Koenig, P.C.

(57) ABSTRACT

What is described is a turbine guide vane having a guide vane leaf and with a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which can be inserted into a reception shape countercontoured within the supporting structure. At least one seal is provided between the connecting structure and the supporting structure.

20 Claims, 3 Drawing Sheets

GUIDE VANE FOR ROTARY TURBO MACHINERY

CROSS REFERENCE TO RELATED APPLICATION

This application is a continuation of International Application No. PCT/EP2006/060880, filed Mar. 20, 2006, which is incorporated by reference as if fully set forth.

FIELD OF INVENTION

The invention relates to a guide vane for turbo machinery, particularly for a gas turbine stage, with a guide vane leaf, and with a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided, at least in portions, a joining contour which can be inserted into a reception shape countercontoured within the supporting structure.

BACKGROUND

Guide vanes of turbo machinery, particularly where a gas turbine plant is concerned, are exposed directly to the hot gases flowing out of the combustion chamber and are consequently subjected to high thermal loads which, in modern gas turbine plants, lie well above the material-specific thermal load-bearing limits of the individual components. For this reason, the gas turbine components, such as, in particular, the guide vanes and rotor blades, which are exposed directly to the hot gases, have to be cooled so that it can be ensured that the respective components do not overheat and suffer any irreversible damage caused by thermally induced material deteriorations. Cooling measures of this type are known in many different forms and normally involve a directed supply of cooling air to the individual components to be cooled, the cooling air being part of the compressed combustion air which emerges from the compressor unit of the gas turbine plant and which is branched off and is therefore unavailable for the further combustion operation.

It is obvious that the cooling air quantity branched off from the compressed supply air for cooling purposes must be kept as low as possible, so as not permanently to influence the performance of the gas turbine plant. Moreover, it is appropriate for the branched-off cooling air fraction to be routed as effectively as possible and without losses, in particular without leakage losses, to the individual gas turbine components to be cooled. With regards the guide vane concept described below, it is appropriate to utilize effectively and without leakage losses the cooling air which is supplied to a guide vane for cooling purposes.

FIGS. 2*a* and 2*b* illustrate respectively a side illustration and a cross-sectional illustration of the radially outer part region of a guide vane 1 with an adjacent stator-side supporting structure 2. FIG. 2*a* shows an axial side view of a guide vane 1 which issues radially inward into the flow duct K. A rotor blade La is indicated highly diagrammatically, offset axially with respect to the guide vane 1. The guide vane 1 has in a way known per se an inner duct system KS which may be gathered from the cross-sectional picture illustrated in FIG. 2*b* and drawn along the sectional plane A-A. To cool the guide vane 1, compressed cooling air L is supplied to the guide vane 1 through a cooling air supply duct SC provided on the stator side.

The guide vane 1 is composed of a guide vane leaf 3 (see FIG. 2*b*), of a platform 4 adjoining the guide vane leaf 3 radially on the outside and of a connecting structure 5 which lies opposite the guide vane leaf 3 in relation to the platform 4 and by means of which the guide vane 1 is fastened in the supporting structure 2 of the casing of the turbomachine or of the gas turbine plant. The platform 4 has in this case a first surface 41 facing the flow duct K and a second surface 42 facing away from the flow duct K. The connecting structure 5 projects radially beyond the plane of the platform surface 42 and with its side wall portions 51 and 52 and the end-face side wall portions, not illustrated in FIG. 2*b*, surrounds an inner cavity 6 which is connected, open, on the one hand, to the cooling air supply duct SC and, on the other hand, to the cooling duct system KS of the guide vane 1. The lateral dimensioning of the cavity 6 in the plane of the platform surface 42 is preferably selected such that the cross-section obtained in a radial projection onto the guide vane leaf 3 of the guide vane 1 is covered preferably completely by the cavity 6, so that all the cooling ducts KS incorporated within the guide vane leaf 3 can be supplied with cooling air L from the cavity 6. This ensures an optimal supply of cooling air to the guide vane leaf 3.

The fastening of the guide vane 1 within the supporting structure 2, mostly of annular design, takes place in recesses 2' which run longitudinally within the supporting structure 2 and into which issue laterally joining contours 7 of collar-shaped design which project beyond the side wall portions 51 and 52 at their upper region. The joining tolerances between the recesses 2' and the joining contours 7 of collar-like design are selected such that, on the one hand, rapid assembly by the joining contours being smoothly introduced longitudinally into the recesses of groove-shaped design is possible, but, on the other hand, gastight pressure between the joining contours and the recesses is ensured for operationally induced heating and associated material expansion, so that no cooling air entering the cavity 6 through the cooling air supply duct SC can pass through the joining connection described above.

For operational and also assembly reasons, an intermediate gap 8 is provided between the radially outermost boundary face 9' of the side wall portions 51 and 52 and the inner contouring of the supporting structure 2 and extends, perpendicularly to the drawing plane illustrated in FIG. 2*b*, over the entire longitudinal extent of the fastening structure 5 and consequently over the end-face wall portions 53 and 54 (FIG. 2*a*). The intermediate gap 8, which is also formed between the end-face wall portions 53 and 54 and the radially opposite supporting structure 2, affords the cooling air flowing into the cavity 6 an excellent possibility of escaping through adjacent gaps. Leakage paths in respect of this may be gathered from FIG. 2*a* with reference to the arrowed illustrations representing in this the leakage flows. Thus, the cavity 6 is supplied from the cooling air supply duct SC with the main cooling air flow, from which part flows can escape laterally, on both sides, through the respective intermediate gaps 8 via the top edges of the end-face wall portions 53 and 54. The laterally escaping cooling air part streams, on the one hand, pass between radially running intermediate gaps 9 between the supporting structure 2 and axially adjacent guide vane casing regions and can ultimately pass, unused, via further intermediate gaps into the flow duct K (see the dashed arrowed illustration). It is appropriate to avoid leakage losses of this type, but without impairing the operating behavior and mountability of the individual components.

SUMMARY

The object on which the invention is based is, on the guide vane concept described above, to take measures whereby the leakage losses of cooling air, lost largely uselessly through intermediate gaps into the flow duct, are reduced. The measures to be taken are not to impair the functioning or the mountability of the individual components. It is likewise to be possible correspondingly to retrofit guide vanes already in use, in order to reduce harmful leakage flows.

The present invention is a turbine guide vane including a guide vane leaf, and a radially outer platform connected to the guide vane leaf. The guide vane also includes a platform surface which faces radially away from the guide vane leaf and on which a connecting structure is provided for fastening the guide vane to a supporting structure. The supporting structure has side wall portions which project radially beyond the platform surface and delimit an inner cavity and on which is provided at least in portions a joining contour which is insertable into a complementary contour within the supporting structure. At least one seal is provided between the connecting structure and the supporting structure.

BRIEF DESCRIPTION OF THE DRAWINGS

The invention is described below by way of example, without any restriction of the general idea of the invention, by means of exemplary embodiments, with reference to the drawing in which.

DETAILED DESCRIPTION OF THE PREFERRED EMBODIMENTS

Introduction to the Embodiments

Figure 1A:
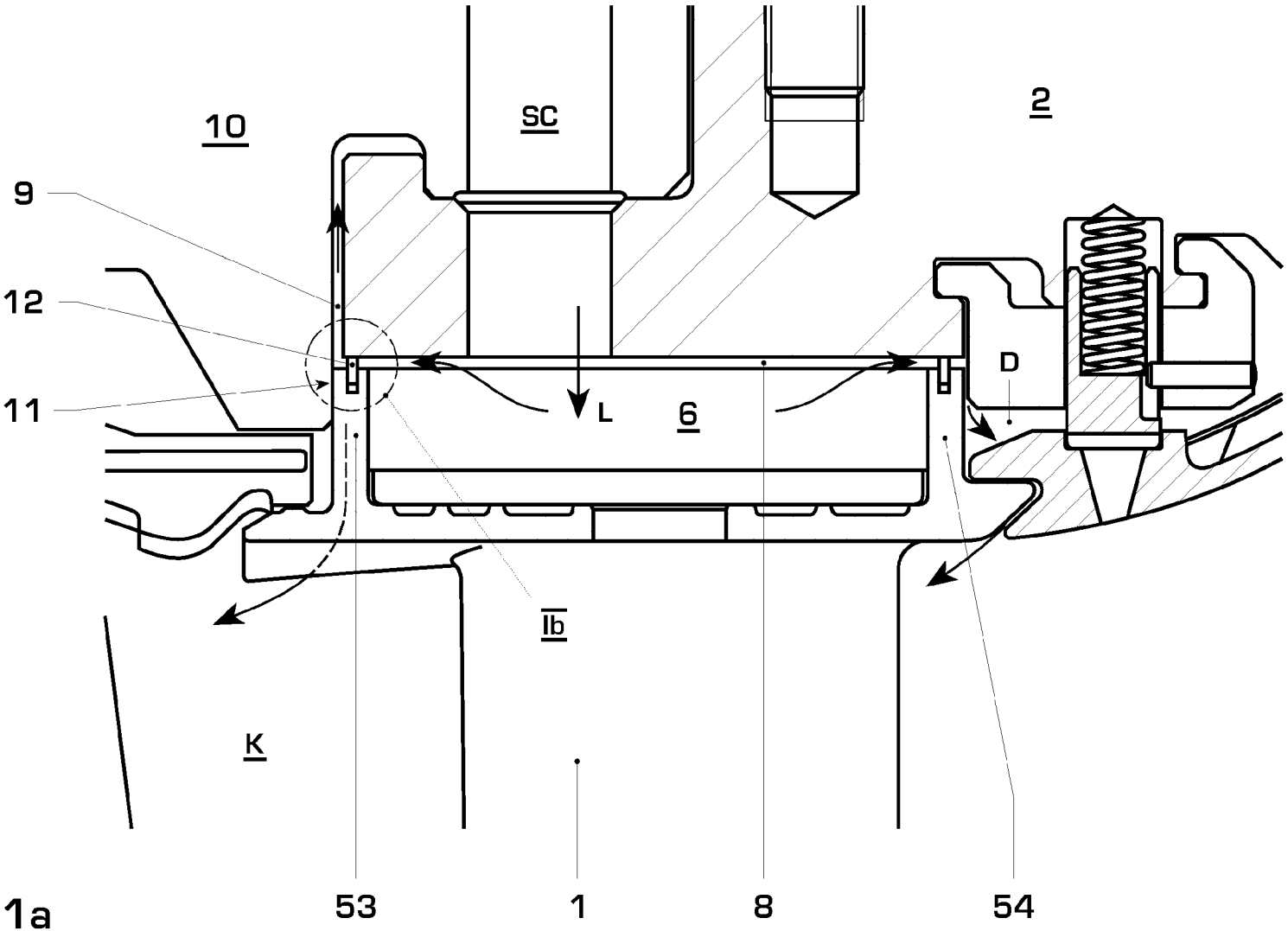
FIG. 1*a* shows a diagrammatic longitudinal sectional illustration of a connection region between a guide vane and a stator-side supporting structure in a gas turbine arrangement.

According to the present invention, a turbine guide vane, particularly for a gas turbine stage, with a guide vane leaf, and with a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which can be inserted into a mating counter contour within the supporting structure, is designed in such a way that at least one seal is provided between the connecting structure and the supporting structure.

The seal is preferably arranged between the connecting structure and the supporting structure in such a way that essentially no leakage streams can escape laterally out of the cavity, which is delimited laterally by the side wall portions of the connection structure, between the radially upper edge of the connecting structure and the supporting structure lying radially opposite this.

Since the connecting structure normally provides four side wall portions which are joined to one another in a rectangular shape and of which two opposite side wall portions have in each case a joining contour of collar-shaped design which, in the inserted state, make a largely gastight connection with the supporting structure, the seal are preferably to be provided between the front and the rear end-face side wall portions, preferably on their boundary faces which in each case lie radially on the outside and which face the supporting structure.

In a preferred embodiment, it is appropriate in this case to introduce, along the abovementioned radially outer boundary faces of the end-face front and rear side wall portions groove-shaped recesses into which the seal designed as band or strip seals can be introduced, the seal being designed so as to be raised above the respective boundary faces. In order to improve the mounting, but, in particular, the sealing properties, of seal of this type, in addition to each individual seal a spring element is to be introduced into the groove-shaped recess, so that the respective seal is pressed from the connecting structure by the action of spring force against a surface region of the supporting structure. The provision of a spring element makes it possible, on the one hand, to select the dimensioning of the groove-shaped recess within the respective side wall portion and also the dimensioning of the seal in such a way that, for mounting purposes, the seal can be pressed completely into the groove-shaped recess counter to the spring force and therefore has no projecting length beyond the radially outer boundary face of the end-face side wall portion in each case. In the state in which the connecting structure is mounted, that is to say inserted, into the corresponding reception shape within the supporting structure, the spring element lying in each case inside the groove ensures that the seal is driven by the action of force radially outward against a surface region provided correspondingly on the supporting structure and thus ensures an effective sealing function. It is likewise conceivable, instead of attaching the seal within the connecting structure, to provide the seal on the supporting structure in a region which lies opposite the front or rear end-face side wall portions.

DETAILED DESCRIPTION

Figure 1C:
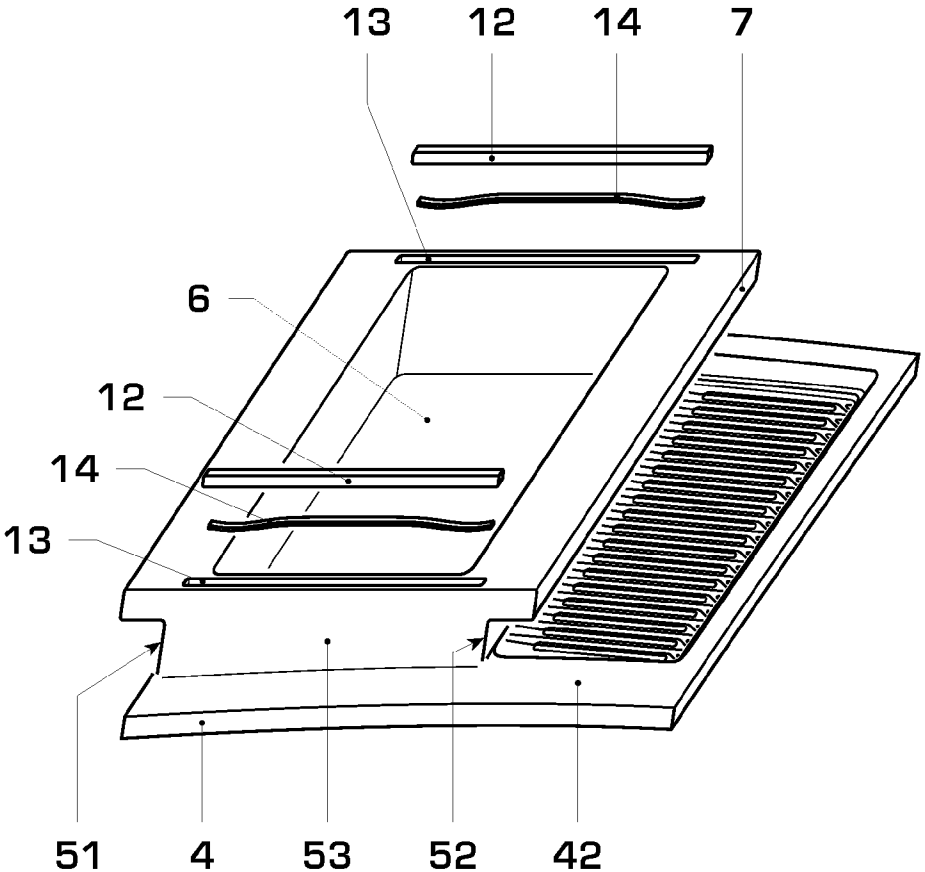
FIG. 1*c* shows a perspective illustration of the connecting structure with a platform.

FIG. 1*a* shows a diagrammatic partial illustration of a longitudinal section through the joining region of a guide vane 1 with a supporting structure which is arranged on the stator side and which is preferably designed as a support ring within a stator casing. In contrast to the guide vane design according to FIG. 2*a*, described above, the guide vane 1 designed according to the present invention provides in each case, on the radially outer boundary faces 11 of the front and rear end-face side wall portions 53 and 54, a seal 12 of which the attachment and configuration within the respective side wall portion are illustrated, enlarged, in the illustration of a detail according to FIG. 1*b*. Within the boundary face 11 of the respective side wall portion 53, 54 a groove-shaped recess 13 is provided in which a spring element 14 and the seal 12 are disposed. The groove-shaped recess 13 extends over essentially the entire length of the radially outer boundary face of the respective side wall portions 53, 54, so that, in a preferred embodiment, the spring element is designed as an elongate flat spring 14 and the seal 12, as it were adapted to the dimensions of the groove-shaped recess 13, assumes a bar-like shape. To further point out a possible preferred design of the spring element 14 and of the seal 12, reference is made to the perspective illustration according to FIG. 1*c* which shows an oblique view of the radially outer surface 42 of the platform 4, with the connecting structure 5 which the side wall portions 51 to 54 have in each case. What can be seen clearly are the side wall portions 51 and 52 which run parallel to one another and at the radially outer edge of which is provided in each case with a collar-shaped formation 7 which ensures a mechanical fastening of the guide vane within the supporting structure. Incorporated on the end-face front and rear side wall portions 53 and 54 are the above-designated groove-shaped recesses 13 in which a spring element 14 and the seal 12 of bar-shape design can be introduced in each case. In addition to the embodiment, depicted in FIG. 1*c*, of the spring 14 of platform design, alternative spring shapes, such as, for example, helical springs or round springs or the like, can also be used.

Figure 1B:
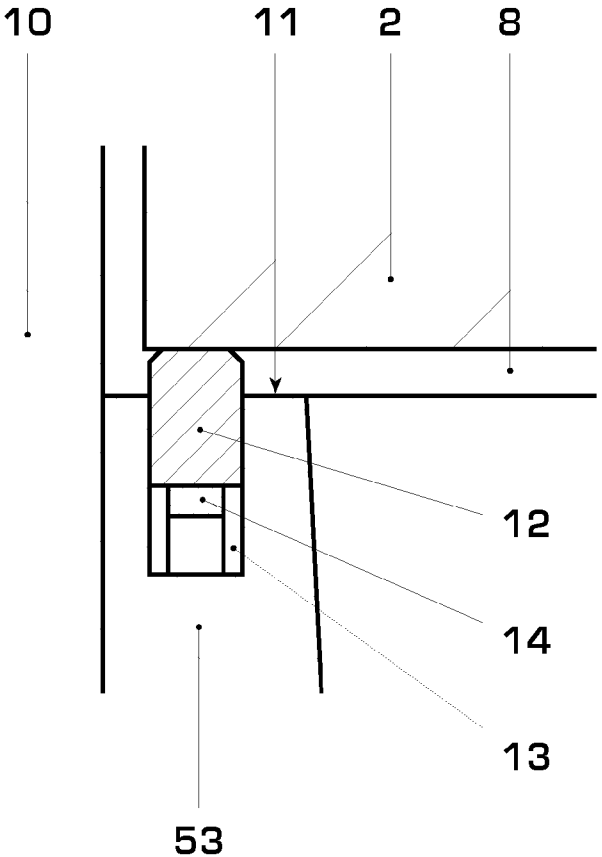
FIG. 1*b* shows a partial illustration of the attachment of a seal within a side wall portion in the connecting structure.
Figure 2A:
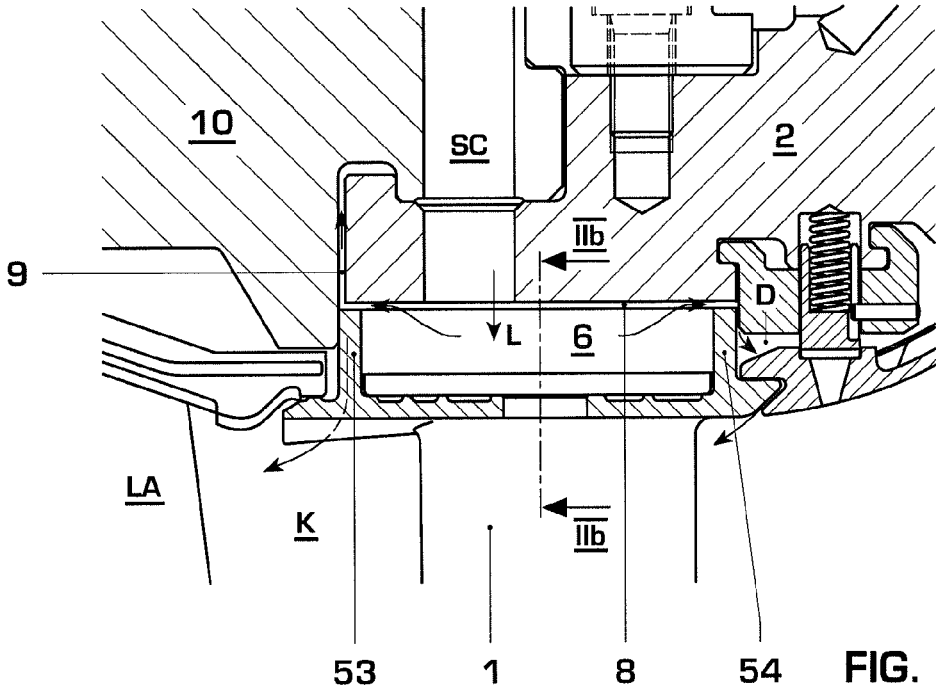
FIG. 2a (Prior Art)
FIG. 2*a* shows a diagrammatic longitudinal section illustration through the connection region between a guide vane and a stator-side supporting structure according to the prior art.
Figure 2B:
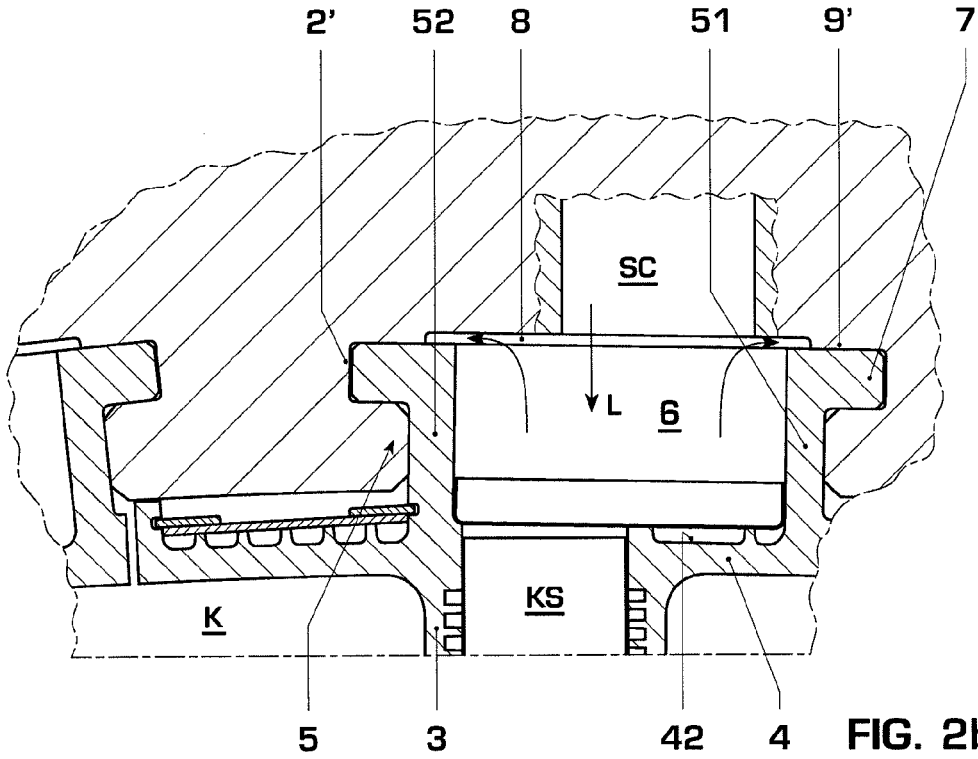
FIG. 2b (Prior Art)
FIG. 2*b* shows a cross-sectional illustration of the connection region between a guide vane and a stator-side supporting structure according to the prior art.

It may be gathered from the illustration of the detail according to FIG. 1*b* that the groove-shaped recess 13 has a groove depth which makes it possible to press the seal 12 into the groove recess 13 completely by the corresponding action of external force on the spring element 14. The ease with which the guide vane is mounted can thereby be improved. In the mounted state, which is depicted in FIG. 1*b*, the seal 12 projects radially upwards out of the groove 13 by the action of spring force and presses, by the action of spring force, against the radially opposite surface region of the supporting structure 2, so that a fluidtight sealing of the intermediate gap 8 is thereby ensured.

By the seal 12, according to the present invention, being provided on the side wall portions 53, 54 of the connecting structure 5 of a guide vane 1, which are arranged in each case on the end face, the situation can be avoided where, according to FIG. 1*a*, the cooling air stream, which enters the cavity 6 of the guide vane 1 from the cooling air supply duct SC, can escape laterally into the intermediate gaps laterally adjacent to the connecting structure 5. Instead, the seal 12 ensure that the cooling air stream is routed virtually entirely within the inner cooling duct systems inside the guide vane and thus serves for optimal cooling of the guide vane.

Since preferably the seal provided along the side wall portion 53 and 54 are in each case designed identically to one another and in each case have a length which brings about a complete sealing of the gap 8 provided for mounting purposes between the connecting structure 5 and the supporting structure 2, the measures to be taken for sealing can be implemented cost-effectively and simply in terms of production. In particular, even guide vanes already in use can be equipped with the proposed sealing system by means of corresponding remachining. Thus, only two milling operations are required, which are necessary in order to produce the two groove-shaped recesses 13.

Modifications to the sealing principle described above may, of course, be envisaged, such as, for example, the integration of the seal within the supporting structure 2 in the region which lies opposite the outer boundary face 11 of the end-face side wall portions 53 and 54.

By the seal 12 being deflected radially due to spring force, the seal 12 is pressed solely perpendicularly against that surface region of the supporting structure 2 which is to be sealed off. On account of this, only pressure forces oriented in the radial direction occur within the seal 12, with the result that the seal experiences an only insignificant mechanical load. Abrasion phenomena on the seal may therefore largely be ruled out, so that the sealing function of the seal remains virtually unlimited. In order to optimize the sealing function, it is appropriate to ensure that the surface contour of the seal 12 is adapted to the surface contour of that surface region of the supporting structure which is to be sealed off.

LIST OF REFERENCE NUMERALS

| | |
|---|---|
| 1 | Guide vane |
| 2 | Supporting structure |
| 2' | Reception shape |
| 3 | Guide vane leaf |
| 4 | Platform |
| 5 | Connecting structure |
| 6 | Cavity |
| 7 | Joining contour |
| 8 | Intermediate gap |
| 9 | Intermediate gap |
| 9' | Boundary face |
| 10 | Guide vane carrier |
| 11 | Radially outer boundary face |
| 12 | Seal |
| 13 | Groove-shaped recess |
| 14 | Spring element |
| 41 | Lower platform surface |
| 42 | Upper platform surface |
| 51 to 54 | Side wall portions |

What is claimed is:

1. A turbine guide vane comprising a guide vane leaf, and a radially outer platform connected to the guide vane leaf and having a platform surface which faces radially away from the guide vane leaf and on which a connecting structure is provided for fastening the guide vane to a supporting structure, the connecting structure has front and rear side wall portions which project radially beyond the platform surface and delimit an inner cavity and on which is provided at least in portions a joining contour which is insertable into a complementary contour within the supporting structure, wherein the front and rear side wall portions each have a seal that extends between the connecting structure and the supporting structure.

2. The guide vane as claimed in claim 1, wherein the at least one seal is acted upon by spring force and is pressed by the connecting structure against the supporting structure.

3. The guide vane as claimed in claim 2, wherein the at least one seal is a strip or band seal and has a longitudinal extent, along which the at least one seal is partially acted upon by a spring element.

4. The guide vane as claimed in claim 2, wherein the at least one seal is a strip or band seal and has a longitudinal extent, along which the at least one seal is acted upon by a spring element.

5. The guide vane as claimed in claim 1, wherein the at least one seal is a strip or band seal and has a longitudinal extent, along which the at least one seal is partially acted upon by a spring element.

6. The guide vane as claimed in claim 5, wherein the at least one seal has a sealing surface which is contoured corresponding to a surface region of the supporting structure or of the connecting structure, against which the at least one seal is pressed by the action of the spring force.

7. The guide vane as claimed in claim 1, wherein the at least one seal provided between the connecting structure and the supporting structure serves for a largely fluid tight closure of the cavity which is delimited by the side wall portions and the supporting structure and into which at least one cooling duct issues from the supporting structure.

8. The guide vane as claimed in claim 1, wherein the at least one seal is acted upon by spring force and is pressed by the supporting structure against the connecting structure.

9. The guide vane as claimed in claim 1, wherein the at least one seal is a strip or band seal and has a longitudinal extent, along which the at least one seal is acted upon by a spring element.

10. A turbine guide vane comprising a guide vane leaf, and a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which is insertable into a complementary contour within the supporting structure, wherein at least one seal is provided between the connecting structure and the supporting structure, and the connecting structure has four side wall portions which are assembled into a rectangular frame and of which two opposite side wall portions have overhanging collars as joining contours which are insertable into complementary recesses within the supporting structure, and the at least one seal is provided along each of the other two end-face side wall portions arranged opposite to each other.

11. The guide vane as claimed in claim 10, wherein the end-face side wall portions each have a radially outer boundary face into which a groove-shaped recess is introduced, and in that at least one spring element and the at least one seal in the form of a band or bar seal adapted to the groove-shaped recess can be inserted into the groove-shaped recess, said at least one seal being prestressed by means of spring force at least partially radially so as to be raised above the boundary face.

12. The guide vane as claimed in claim 11, wherein the spring element is a band, spiral, helical or round spring.

13. The guide vane as claimed in claim 12, wherein the at least one seal is mounted so as to be deflectable solely perpendicularly in relation to the surface region of the supporting structure.

14. The guide vane as claimed in claim 11, wherein the at least one seal is mounted so as to be deflectable solely perpendicularly in relation to the surface region of the supporting structure.

15. The guide vane as claimed in claim 10, wherein the at least one seal is mounted so as to be deflectable solely perpendicularly in relation to the surface region of the supporting structure.

16. A turbine guide vane comprising a guide vane leaf, and a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which is insertable into a complementary contour within the supporting structure, wherein at least one seal is provided between the connecting structure and the supporting structure, the at least one seal is a strip or band seal and has a longitudinal extent, along which the at least one seal is partially acted upon by a spring element, the at least one seal has a sealing surface which is contoured corresponding to a surface region of the supporting structure or of the connecting structure, against which the at least one seal is pressed by the action of the spring force, and the at least one seal is mounted so as to be deflectable solely perpendicularly in relation to the surface region of the supporting structure.

17. A turbine guide vane comprising a guide vane leaf, and a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which is insertable into a complementary contour within the supporting structure, wherein at least one seal is provided between the connecting structure and the supporting structure, the at least one seal is a strip or band seal and has a longitudinal extent, along which the at least one seal is partially acted upon by a spring element, the at least one seal has a sealing surface which is contoured corresponding to a surface region of the supporting structure or of the connecting structure, against which the at least one seal is pressed by the action of the spring force, and the at least one seal is mounted so as to be deflectable solely perpendicularly in relation to the surface region of the connecting structure.

18. A turbine guide vane comprising a guide vane leaf, and a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which is insertable into a complementary contour within the supporting structure, wherein at least one seal is provided between the connecting structure and the supporting structure, the at least one seal is acted upon by spring force and is pressed by the connecting structure against the supporting structure, and the connecting structure has four side wall portions which are assembled into a rectangular frame and of which two opposite side wall portions have overhanging collars as joining contours which are insertable into complementary recesses within the supporting structure, and the at least one seal is provided along each of the other two end-face side wall portions arranged opposite to each other.

19. A turbine guide vane comprising a guide vane leaf, and a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which is insertable into a complementary contour within the supporting structure, wherein at least one seal is provided between the connecting structure and the supporting structure, the at least one seal is a strip or band seal and has a longitudinal extent, along which the at least one seal is partially acted upon by a spring element, and the connecting structure has four side wall portions which are assembled into a rectangular frame and of which two opposite side wall portions have overhanging collars as joining contours which are insertable into complementary recesses within the supporting structure, and the at least one seal is provided along each of the other two end-face side wall portions arranged opposite to each other.

20. A turbine guide vane comprising a guide vane leaf, and a radially outer platform connected to the guide vane leaf and having a platform surface which faces radially away from the guide vane leaf and on which a connecting structure is provided for fastening the guide vane to a supporting structure which has side wall portions which project radially beyond the platform surface and delimit an inner cavity and on which is provided at least in portions a joining contour which is insertable into a complementary contour within the supporting structure, wherein at least one seal is provided between the connecting structure and the supporting structure, the at least one seal is a strip or band seal and has a longitudinal extent, along which the at least one seal is partially acted upon by a spring element, the at least one seal has a sealing surface which is contoured corresponding to a surface region of the supporting structure or of the connecting structure, against which the at least one seal is pressed by the action of the spring force, and the connecting structure has four side wall portions which are assembled into a rectangular frame and of which two opposite side wall portions have overhanging collars as joining contours which are insertable into complementary recesses within the supporting structure, and the at least one seal is provided along each of the other two end-face side wall portions arranged opposite to each other.

* * * * *